US005375714A

United States Patent [19]

Burnett

[11] Patent Number: 5,375,714

[45] Date of Patent: Dec. 27, 1994

[54] DEVICE TO MAINTAIN VERTICAL POSITION OF COMIC BOOKS AND MAGAZINES DURING STORAGE

[76] Inventor: Randy B. Burnett, 7779 Melrose Ave., Los Angeles, Calif. 90046

[21] Appl. No.: 147,858

[22] Filed: Nov. 5, 1993

[51] Int. Cl.[5] ..... A45F 5/12

[52] U.S. Cl. ..... 206/424; 229/120.38

[58] Field of Search ..... 217/64; 220/534, 559; 229/120.37, 120.38; 206/424, 425

[56] References Cited

U.S. PATENT DOCUMENTS 3,963,167 6/1976 Newgaard, II ..... 206/425 X
4,120,443 10/1978 Gardner et al. ..... 206/424 X
4,148,396 4/1979 Gardner ..... 206/424 X
4,520,922 6/1985 Beach ..... 206/425 X
4,793,494 12/1988 Gordon, Jr. ..... 229/120.38 X
5,269,456 12/1993 Regis et al. ..... 229/120.38

*Primary Examiner*—William I. Price

[57] ABSTRACT

A rectangular storage box combined with a rectangular box-like filler for storing rectangular paper articles. The filler has only three connected planar vertical extending sides with two of the sides parallel to each other and all of the sides connected to a horizontal planar top side at their top edges. The filler is adapted to receive and maintain the paper articles on their ends extending in a vertical position. The storage box is constructed to receive the filler in a close fitting relationship with the two parallel sides of the filler being parallel with the sides of the box and the third vertical side of the filler being parallel to the ends of the box.

15 Claims, 5 Drawing Sheets

DEVICE TO MAINTAIN VERTICAL POSITION OF COMIC BOOKS AND MAGAZINES DURING STORAGE

BACKGROUND OF INVENTION

1. Field of Invention

The present invention relates to devices and methods for holding comic books and magazines and, in preferred embodiments, for maintaining comic books and magazines in a vertical position while the same are stored in boxes, cartons and related storage devices.

2. Description of Related Art

Collecting comic books and magazines has been steadily growing in popularity. Individual comic books have been sold at auctions for tens of thousands of dollars, and comic and magazine hobby shops have spring up all around the country.

Comics books are customarily grouped into "ages" depending on their year of publication. Specifically, books are considered to have been published just prior to, during, or just subsequent to one of three "ages," the Golden Age for books published between 1938 and 1945, the Silver Age for books published between 1956 and 1969, and the Post-Silver Age or Modern Age for books published between 1969 and the present. Golden Age books typically have approximate dimensions of $10\frac{1}{4}$ inches high by $7\frac{5}{8}$ inches wide. Silver Age books typically have approximate dimensions of $10\frac{1}{8}$ inches high by $7\frac{1}{8}$ inches wide. Modern Age books typically have approximate dimensions of $10\frac{1}{8}$ inches high by $6\frac{5}{8}$ or $6\frac{7}{8}$ inches wide. The depth of any of these comic books typically ranges between 1/16 of an inch and $\frac{1}{8}$ of an inch.

Magazines vary widely in sizes. Modern magazines typically have approximate dimensions of between 10 and 11 inches high by between 8 and 9 inches wide, with depths of $\frac{1}{4}$ of an inch to a few inches.

The proper storage of comic books and magazines (collective "comic(s)") or "comic book(s)" is the most important factor in prolonging their life and ensuring that their value is retained. A preliminary storage method employed by many comic collectors and retail businesses involves the use of a storage bag. A collector will individually "seal" a comic book in a bag made of plastic or other suitable material. (For very expensive comics, the "bag" may actually be a frame-like construct made of a rigid plastic.) Such storage bags are well known and commercially available; they come in standardized sizes which allow comics of all three ages to be "bagged."

To assist in keeping comics flat, so as to reduce damage to the spine of the comic books as well as to maintain the general, overall appearance of the books, many collectors and retailers employ a device called a backing board. Backing boards are well known and commercially available; they are comprised of a single piece of cardboard, acid free cardboard or other suitable material which is cut to a size which approximates the height and width of a comic book. The backing board is placed into a storage bag behind the comic book, such that the backing board is positioned between the back of the comic book and the inside of the back side of the storage bag.

The combination of tightly fitting storage bag and semi-rigid backing board assists in "encouraging" a stored comic book to remain flat. However, backing boards are typically no thicker than 1/32 of an inch.

Therefore, their ability to prevent damage when comics are moved around or stored improperly is minimal.

In a preferred storage arrangement, the comic books are maintained vertically. Storage boxes are commonly employed as the device in which to so store comic books. Storage boxes are usually constructed of acid-free cardboard or other suitable material such as corrugated cardboard. Such storage boxes are well known and have been commercially available since 1974 or 1975. Comic book storage boxes typically come in one of two sizes: (i) a box with approximate interior dimensions of $7\frac{3}{4}$ inches wide by $10\frac{1}{4}$ inches high by $25\frac{1}{2}$ to 26 inches deep (often referred to as "long boxes"), and (ii) a box with approximate interior dimensions of $7\frac{3}{4}$ inches wide by $11\frac{1}{4}$ inches high by 13 inches deep (often referred to as "short boxes"). Boxes are also commercially available in sizes to specifically accommodate magazines, such boxes typically having the following approximate interior dimensions: $8\frac{3}{4}$ inches wide by $11\frac{1}{4}$ inches high by 15 inches deep.

Exterior dimensions vary depending on the "thickness" of the material used to make the storage container.

Commercially available storage boxes are typically constructed from two pre-cut, sheets of acid-free cardboard or other suitable material such as corrugated cardboard. One piece is pre-glued to form a "square loop" with two bottom flaps. This piece is folded into a five-sided, opened-top box, this shape being held in place through the use, typically, of counter pressure and friction. The second piece is a flat sheet which is folded into a five-sided top which fits over the open top of the box, overlapping all four vertical sides of the box; the shape of the top is held in place through the use, typically, of two or four "tab and slot") or "tab and groove" combinations.

To provide maximum protection to stored comic books, the comic books are placed in individual storage bags along with a backing board, and are then stored vertically in a storage box. With commercially available storage boxes, the interior dimensions are typically such as to largely inhibit, or at least discourage, side-to-side movement which could otherwise damage the edges of the comic books. The combination of storage bag and backing board also adds some rigidity to the individual comics, although the backing boards are not of sufficient thickness to prevent bending or folding when the comic book moves beyond an "absolute" vertical position.

Even with these means of storage, the comics are subject to incurring damage when placed in an incompletely filled storage box, carton or similar device. Specifically, the excess space encourages, and almost invariably results in, the stored comic books moving out of a vertical position, especially when the storage boxes are physically moved. In other words, unless and until the entire storage box is filled, comics will fall forward (top first), slide forward (bottom first), or otherwise shift (e.g., moving out of a position perpendicular to the side of the storage box). Such unwanted movement results in the stored comic books becoming bent, ripped, or otherwise damaged. For example, if the comic books slide forward, the middle of the comic book, even with a backing board, will tend sag and result in permanently bent spine. Such damage reduces, if not completely eliminates, the value of the stored comic books.

To avoid the problems of damage resulting from movement within a storage box, comic collectors and retailers have simply filled the excess space with whatever materials are on hand ("filler"), for example wadded up newspaper. Such devices and methods have proven ineffectual in many instances. Much material is not sufficiently rigid as to ultimately prevent movement of the comic books; in these situations, the weight of the comic books, especially when the storage box is physically moved, will compress the filler resulting in excess space. On the other hand, the filler may prove to be of such a shape as will dig into, cut, mar or otherwise damage the comic books, especially when movement thrusts the comic books against the filler. Fillers currently employed are typically not structured to specifically work within the dimensions of commercially available storage boxes.

SUMMARY OF THE DISCLOSURE

It is an object of embodiments of the present invention to provide a device or method for preventing comic books and magazines from moving out of a vertical position by more than a few degrees while the same are stored in boxes, cartons and related storage devices. According to one embodiment of the invention, this object is accomplished by inserting a fixed-size, rigid, four-sided box-shaped construct into the excess space within a standardized storage box. The construct is of such outer dimensions as to snugly fit into the storage box. When turned in one direction, it presents a rigid but smooth surface to the front, stored comic. In this position, the stored comics are held in a vertical position without risk of damage to the front comic; in addition, multiple constructs can be utilized in tandem as needed to fill the excess space. When turned 180 degrees, the interior of the construct is exposed to the stored comics; the interior dimensions are such that the construct can be fit over the comics within the storage box, permitting the construct to be stored within a filled storage box without damage to the comics.

According to the illustrated embodiment, the construct is shaped as a rectangular box missing one of the sides which would otherwise face the front or back of the storage box, and the side which would otherwise face the bottom of the storage box, and being of such exterior width and height as to permit the construct to snugly fit into a storage box. The interior width and height are such as to permit the construct to fit over the stored comics.

When one or more constructs are placed within a storage box with the solid side facing the front comic book, the result is that the comics are maintained in a vertical position, even during movement of the storage box. By turning the construct 180 degrees, it is capable of fitting over the comics while still remaining within the storage box; in this fashion one or more constructs can be stored within a full storage box without damage to the comics stored therein.

Also according to the illustrated embodiment, the device can be constructed from a single, flat sheet of pre-cut cardboard or suitable material; when cut properly, the single sheet of material can be folded into the construct, using two "tab and slot" combinations to maintain the shape without the need for adhesives, staples, clamps or the like.

BRIEF DESCRIPTION OF THE DRAWINGS

The detailed description will be made with reference to the accompanying drawings, wherein like numerals designate corresponding parts in the several figures.

DETAILED DESCRIPTION OF THE PREFERRED EMBODIMENTS

The following detailed description is of the best presently contemplated mode of carrying out the invention. This description is not to be taken in a limiting sense, but is merely for the purpose of illustrating the general principles of embodiments of the invention. The scope of the invention is best defined by the appended claims.

While embodiments of the invention are described herein with reference to storing comic books and magazines, it will be recognized that further embodiments of the invention may be of such dimensions and configuration so as to be suitable for storing other objects, such as trading cards, records, sheet music, or the like.

Figure 1:
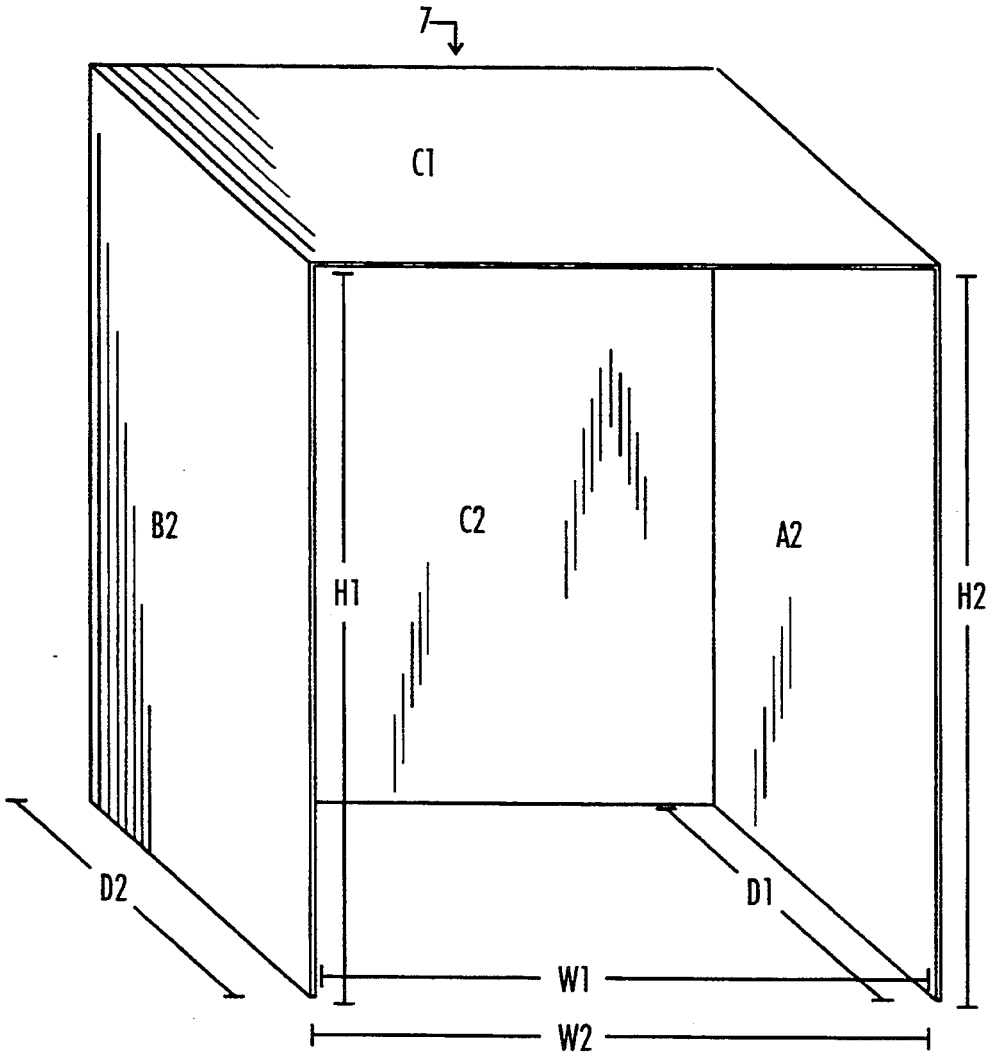
FIG. 1 is a perspective view of the filler construct according to an embodiment of the invention.
Figure 2:
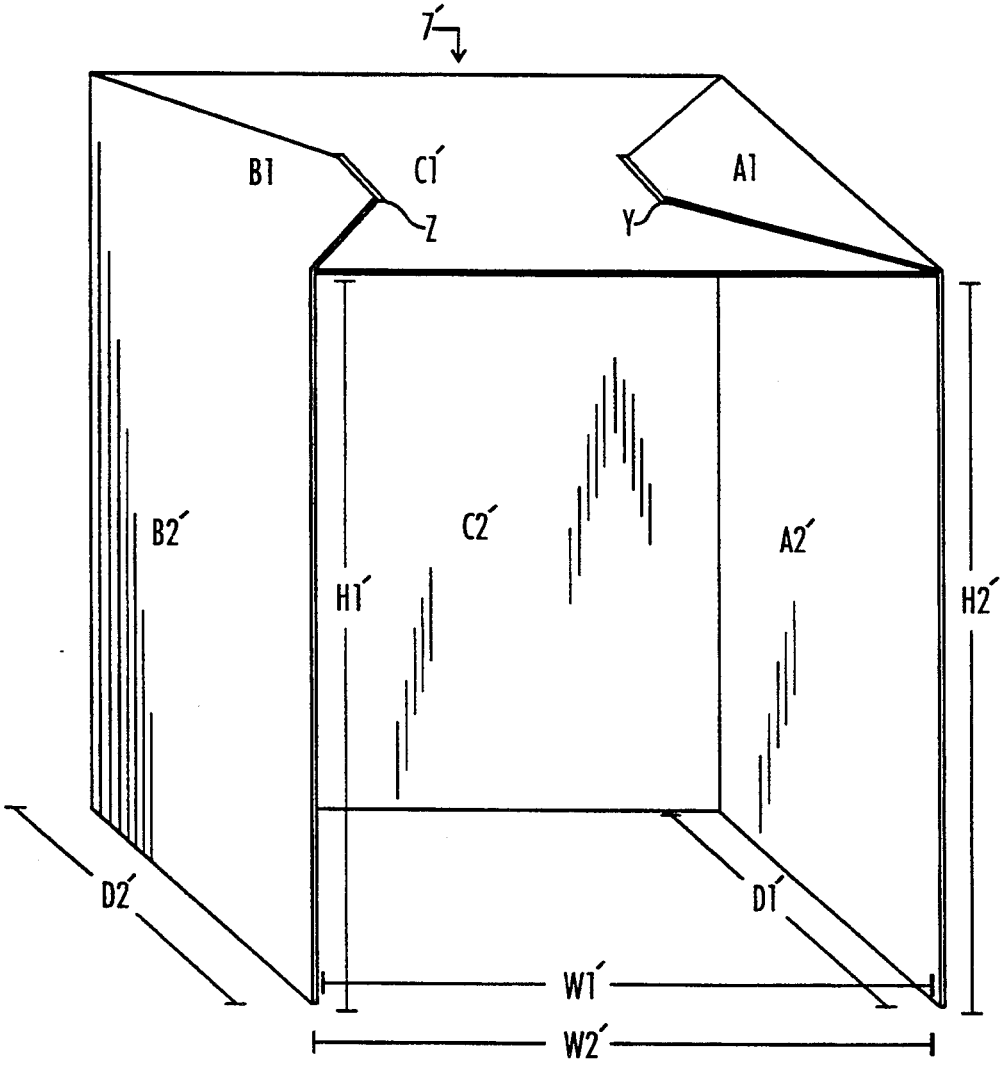
FIG. 2 is a perspective view of the filler construct according to an embodiment of the invention wherein the filer construct has been folded into shape from a single, flat piece of suitable material.
Figure 4:
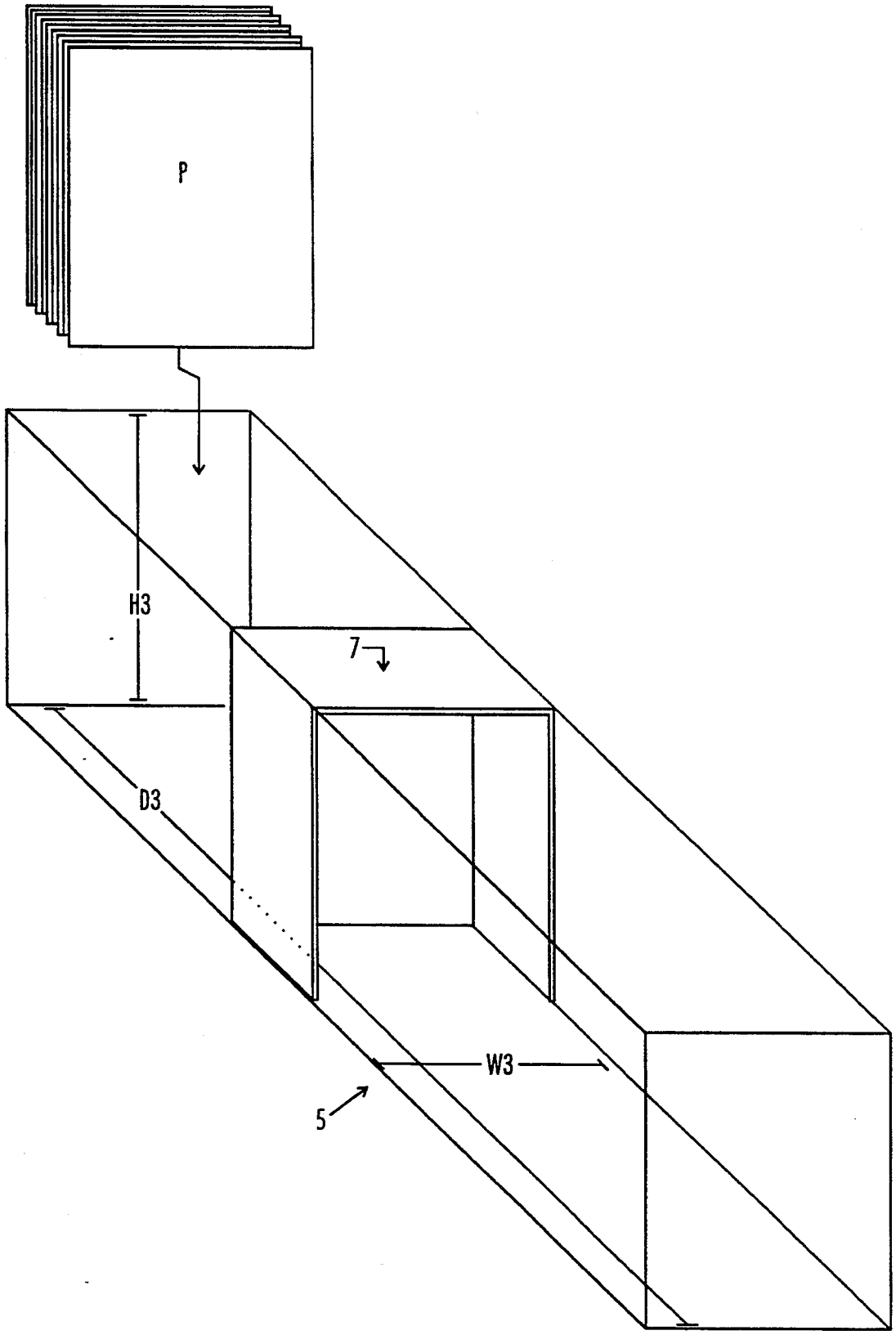
FIG. 4 is a perspective view of the filler construct of FIG. 1 placed within an empty comic storage box in which the materials to be stored are to be placed in front of the filler construct of FIG. 1.
Figure 5:
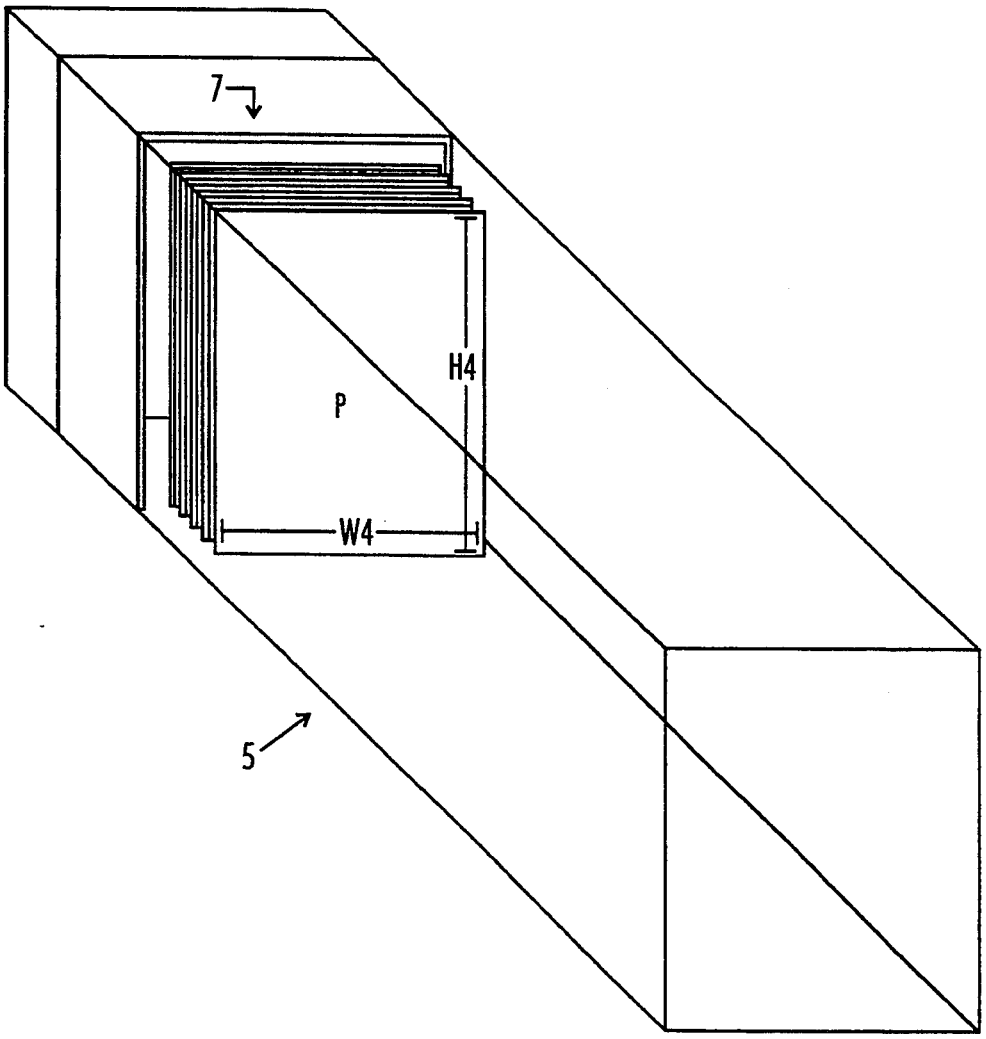
FIG. 5 is a perspective view of the filler construct of FIG. 1 placed within a partially filled comic storage box in which the stored materials are placed behind the filler construct of FIG. 1.

A filler according to an embodiment of the present invention is shown in FIGS. 1 and 2. The illustrated embodiment comprises a generally boxed-shaped filler construct 7. As explained in further detail below, the filler construct 7 is designed to fit within a less-than-filled storage box, carton or other similar device 5, as shown in FIG. 4, so as to inhibit stored comic books and/or magazines P from moving out of a vertical position by more than a few degrees. As explained in further detail below, the filler construct 7 is also designed to fit within such storage devices 5, when the same are full, as shown in FIG. 5.

Figure 3:
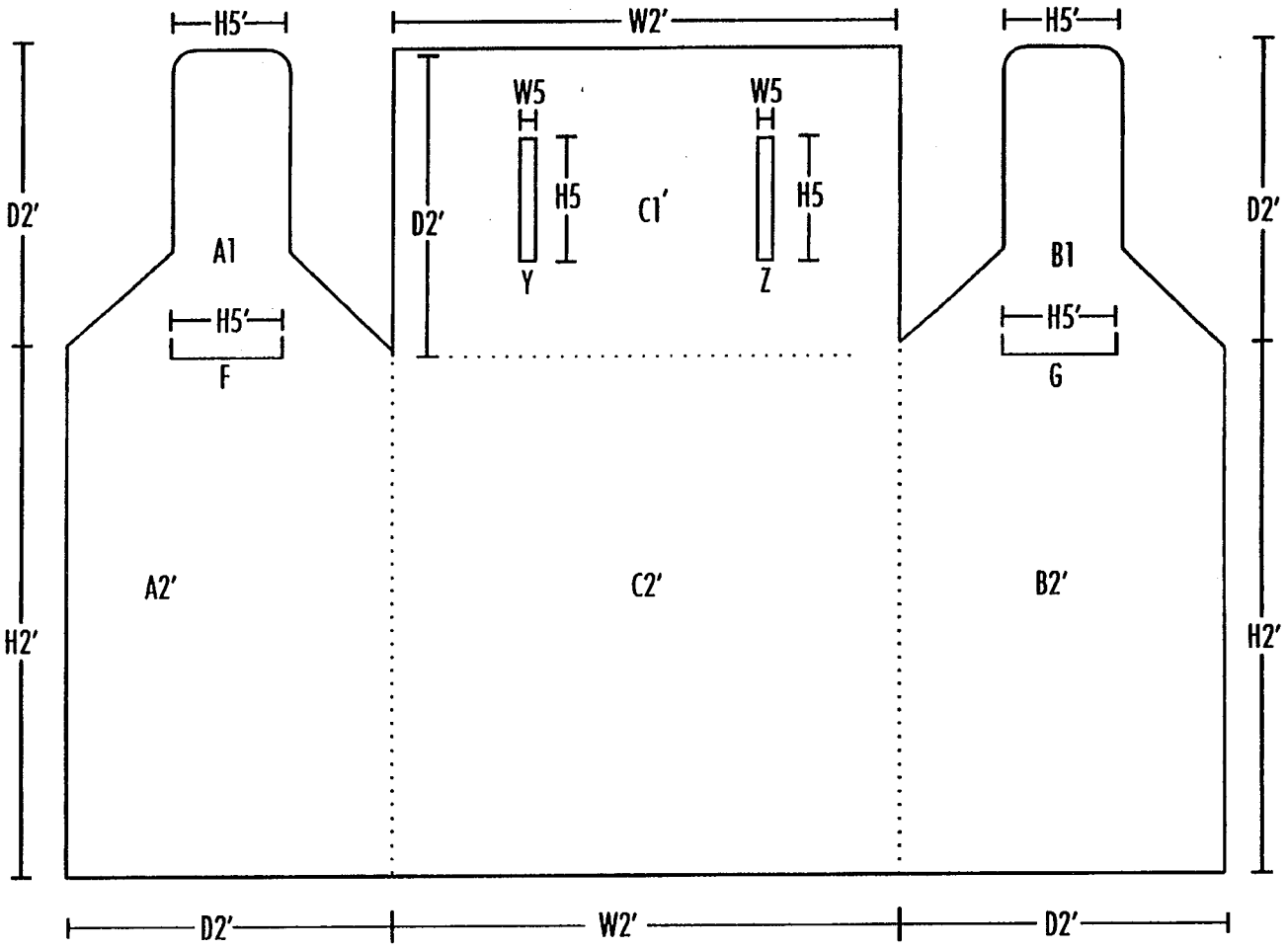
FIG. 3 is a view of the pre-cut, flat sheet of material which can be folded into the filler construct of FIG. 2.

The illustrated embodiment also comprises a filler construct 7 which can be constructed from a single flat, pre-cut piece of acid free cardboard, corrugated cardboard, or other suitable material, as shown in FIGS. 2 and 3.

The filler construct 7 has a generally boxed-shaped, four-sided, hollow body made of cardboard, plastic, wood, metal or any suitable material. In any case, it is preferable that all interior and exterior surfaces be smooth so as not to cause damage to the storage device 5, or the comic books and/or magazines P stored therein.

The filler construct 7 has two sides, A2 and B2, a front C2, and top C1. The filler construct 7 has an exterior width W2 that is slightly less that the interior width W3 of the storage device 5. The filler construct 7 has an exterior height H2 which is equal to, or slightly less than, the interior height H3 of the storage device 5. The filler construct 7 has an exterior depth D2 which is less than the interior depth D3 of the storage device 5.

The filler construct 7 has an interior width W1 that is greater than the width W4 of the stored comic books or magazines P, and an interior height H1 that is greater than the height H4 of the stored comic books or magazines P. In any case, it is preferable that the interior width W1 and interior height H1, respectively, be only slightly greater than the width W4 and height H4, respectively, of the stored comic books and/or magazines P, inclusive of any increase in the width and height of the stored comic books and/or magazines P caused by the concurrent use of storage bags and backing boards.

An embodiment of the present invention, as illustrated in FIG. 3, allows the filler construct 7 to be constructed from a single pre-cut, flat sheet of acid-free cardboard, corrugated cardboard, or other suitable material. The sheet can be viewed as comprised of six segments. The two outer bottom segments, A2′ and B2′, correspond to side A2 and side B2, respectively, of the filler construct 7. The width D2′ and height H2′ of the outer bottom segments are equal to the exterior depth D2 and height H2 of the filler construct 7, respectively. The middle, bottom segment C2′ corresponds to the front C2 of the filler construct 7. The width W2′ and height H2′ of the lower middle segment C2′ are equal to the exterior width W2 and height H2 of the filler construct 7, respectively.

The upper middle segment C1′ corresponds with the top C1 of the filler construct. The width W2′ and the height D2′ of the upper, middle segment C1′ are equal to the exterior width W2 and depth D2 of the filler construct 7, respectively. Two slots, Y and Z, are located in the upper middle segment C1′, being placed approximately ⅓ of the distance in from either side, and being otherwise centered. The width W5 of each slot is equal to, or just slightly larger than, the "thickness" of the material used to make the construct. The length H5 of each slot is just slightly larger than the length/width of the "tab" endings of the top left segment A1 and the top right segment B1.

The base width D2′ and height H6 of the two outer top segments, A1 and B1, are each equal to the exterior depth D2 of the filler construct 7. Each segment cuts in, from the lower left and right corners of said segment, at approximately a 45 degree angle as it approaches the middle of the segment. The cut in continues until the respective segment, at a point approximately half-way up its height, has a width of H5′. The segment then extends vertically in FIG. 3 until its height equals H6. The strait portions of A1 and B1, respectively, become the tabs ("A1 tab" and "B1 tab," respectively) which will fit in the slots Y and Z, respectively.

In the middle of the junction of A1 and A2′ and B1 and B2′, respectively, small cuts are made which terminate with a vertical cut at both ends, F and G, respectively. These small cuts, F and G, respectively, run for a length H5′, the positioning of said cuts paralleling the positions of the A1 tab and B1 tab, respectively.

The filler construct 7 can be constructed from the single pre-cut, flat sheet of suitable material, as described above, by first folding segments A2′ and B2′ in by 90 degrees such that they are each perpendicular to segment C2′. Segment C1′ is then folded down 90 degrees, in the same direction as segments A2′ and B2′ were folded, such that it is perpendicular to segment C2′. Segment A1 is then folded over segment C1′ until it is in contact with segment C1′, with the A1 tab being placed into and through slot Y. Segment B1 is then folded over segment C1′ until it is in contact with segment C1′, with the B1 tab being placed into and through slot Z. A1 tab and B1 tab are then folded back in the direction of segment A2′ and B2′, respectively, until they are in contact with the "underside" of segment C1′.

Ideally, the single pre-cut, flat sheet of suitable material from which the filler construct 7 can be constructed should not be so thick as would cause the interior dimensions of a filler construct 7 so constructed to be smaller than width W1, height H1 and depth D1.

In operation, the filler construct 7 is placed in the empty space of a less-then-filled storage box, carton or similar device, with the exterior surface of the front C2 of the filler construct 7 facing the front stored comic book or magazine. Depending on the size of the empty space and the exterior depth D2 of the filler construct 7, two or more filler constructs can be used in tandem until the space is sufficiently filled such that the exterior surface of the front C2 of a filler construct 7 will be very close to, if not in actual contact with, the front stored comic book or magazine, and the back of the "end" filler construct 7 is in contact with the opposite, interior side of the storage box, carton or similar device.

Such use of the filler construct 7 will prevent movement of the stored comic books and magazines P, thereby maintaining these publications in the preferred vertical storage position. Use of the filler construct 7 thereby will prevent damage such as bending, ripping and pinching to the stored comic books and magazines P caused by slipping, falling, shifting and other such movements, especially during physical movement of the storage device, without itself posing any risk of damage.

When a storage device is filled, the filler construct can be rotated 180 degrees and inserted into the storage device directly over the stored comic books or magazines P, such that the interior of the filler construct 7, rather than "filling" empty space, will be "filled" with the stored publications. In this fashion, a number of filler constructs 7 can themselves be stored within an already filled storage box, carton or other similar device.

The device according to the illustrated embodiment may be easily and inexpensively manufactured. And, as the filler construct is capable of being constructed from a single pre-cut, flat sheet of suitable material, it may be easily stored and shipped until ready to be used, and then subsequently "deconstructed" as necessary. The illustrated embodiment, therefore, provides a simple-to-use and inexpensive solution to the damage and reduction in value caused to stored comic books and magazines when they move out of a vertical storage position, especially during physical movement of the storage device, an undesirable effect which can, and usually does, arise in all storage boxes, cartons and similar devices.

What is claimed:

1. In combination, a rectangular storage box and rectangular box-like filler for storing rectangular paper articles, said filler having only three connected planar vertical extending sides with two of said sides parallel to each other and all of said sides connected to a horizontal planar top side at their top edges, said filler constructed to receive and maintain said paper articles on their ends extending in a vertical position, said storage box being constructed to receive said filler in a close fitting relationship with said two parallel sides of the filler parallel to the sides of the box and the third vertical side parallel to the end of the box.

2. The combination of claim 1 wherein said filler is constructed from a single, flat sheet of acid free cardboard.

3. The combination of claim 2 wherein said flat sheet consists of three panels in a side by side relationship with the outside panels comprising said two parallel sides and having a tab connected at each top edge and the center panel comprising said third side and having said top side with two slots therein connected to its top edge.

4. The combination of claim 1 wherein comic books are stored as the paper articles.

5. The combination of claim 1 wherein magazines are stored as the paper articles.

6. The combination of claim 1 wherein said filler is constructed from a single, flat sheet of corrugated cardboard.

7. The combination of claim 6 wherein said flat sheet consists of three panels in a side by side relationship with the outside panels comprising said two parallel sides and having a tab connected at each top edge and the center panel comprising said third side and having said top side with two slots therein connected to its top edge.

8. A storage system as recited in claim 1 wherein said filler is constructed from a single, flat sheet of acid free cardboard.

9. A storage system as recited in claim 1 wherein said filler is constructed from a single, flat sheet of corrugated cardboard.

10. A storage system as recited in claim 2 wherein said flat sheet comprises of three panels in a side by side relationship with the outside panels comprising said two parallel sides and having a tab connected at each top edge and the center panel comprising said third side and having said top side with two slots therein connected to its top edge.

11. A storage system as recited in claim 6 wherein said flat sheet comprises of three panels in a side by side relationship with the outside panels comprising said two parallel sides and having a tab connected at each top edge and the center panel comprising said third side and having said top side with two slots therein connected to its top edge.

12. A storage system as recited in claim 1 wherein comic books are stored as the articles.

13. A storage system as recited in claim 1 wherein magazines are stored as the articles.

14. A storage system comprising:

a generally rectangular box-like filler for storing generally rectangular articles, said filler having no more than three connected planar vertical extending sides, with two of said sides being parallel to each other, and each of said sides having an upper edge, said filler further having a horizontal planar top side connected to the upper edge of each of said three sides, said filler constructed to receive and maintain said articles in a vertical position; and a storage box having at least two parallel sides and two parallel ends and being constructed to receive said filler in a close fitting relationship, with said two parallel sides of said filler being parallel to said two storage box sides and the third side of said filler being parallel to said two box ends.

15. A storage system comprising:

a generally rectangular box-like filler for storing generally rectangular articles, said filler having three connected side panels and an open forth side, with two of said side panels facing each other, said filler further having a further panel connected to said three side panels, said filler constructed to receive and maintain said articles in a vertical position; and a storage box having at least two facing sides and two facing ends defining an interior configured to receive said filler in a close fitting relationship, with said two facing side panels of said filler being adjacent to said two facing storage box sides and the third side panel of said filler facing one of said two box ends.

* * * * *